US007257959B2

(12) United States Patent
Kim

(10) Patent No.: US 7,257,959 B2
(45) Date of Patent: Aug. 21, 2007

(54) INTEGRAL TYPE AIR CONDITIONER

(75) Inventor: Su Hun Kim, Chanwon-si (KR)

(73) Assignee: LG Electronics Inc., Seoul (KR)

( * ) Notice: Subject to any disclaimer, the term of this patent is extended or adjusted under 35 U.S.C. 154(b) by 296 days.

(21) Appl. No.: 10/917,485

(22) Filed: Aug. 13, 2004

(65) Prior Publication Data

US 2005/0039480 A1 Feb. 24, 2005

(30) Foreign Application Priority Data

Aug. 18, 2003 (KR) ..... 10-2003-0056839

(51) Int. Cl.
*A47F 3/04* (2006.01)

(52) U.S. Cl. ..... 62/246; 62/262

(58) Field of Classification Search ..... 62/246, 62/262, 263, 407
See application file for complete search history.

(56) References Cited

U.S. PATENT DOCUMENTS 5,117,652 A * 6/1992 Takeuchi et al. ..... 62/291
5,228,306 A * 7/1993 Shyu et al. ..... 62/176.6
6,009,716 A * 1/2000 Aoto et al. ..... 62/262

FOREIGN PATENT DOCUMENTS

CN 1231402 A 10/1999
JP 60-186632 9/1985

* cited by examiner

*Primary Examiner*—Melvin Jones
(74) *Attorney, Agent, or Firm*—McKenna Long & Aldridge LLP.

(57) ABSTRACT

A front panel for an integral type air conditioner is provided. The front panel of the integral type air conditioner has a side intake formed at a side portion thereof such that desired air is introduced. The front panel also includes a discharge hole through which the intake air into the air conditioner is discharged.

17 Claims, 6 Drawing Sheets

INTEGRAL TYPE AIR CONDITIONER

BACKGROUND OF THE INVENTION

1. Field of the Invention

This application claims the benefit of Korean Patent Application No. 2003-56839, filed in Korea on Aug. 18, 2003, which is hereby incorporated by reference for all purposes as if fully set forth herein. The present invention relates to an air conditioner, and more particularly, to an integral type air conditioner which increases thermal efficiency, and eases transportation.

2. Description of the Related Art

In a general integral type air conditioner, an indoor unit part and an outdoor unit part are constructed as a single body thereby making unnecessary a long hose, which eases installation, transportation, etc., thereby increasing demand. Further, the indoor unit part is disposed indoors to cool air and the outdoor unit part is disposed outdoors to cool a hot working fluid.

FIG. 1 is an exploded perspective view illustrating a conventional integral type air conditioner. Construction and operation of the conventional integral type air conditioner will be described with reference to FIG. 1.

As shown, the air conditioner includes a base panel 1 formed on a bottom surface of the air conditioner; an indoor unit part formed indoors to cool indoor air; and an outdoor unit part formed outdoors to exhaust hot air.

The indoor unit part includes a front grill 3 formed on an indoor front surface of the base panel 1; an intake grill 4 formed on a front surface of the front grill 3; an indoor heat exchanger 5 formed at an inner side of the front grill 3; an air guide 7 formed at an inner side of the indoor heat exchanger 5; a scroll 9 formed at an inner side of the air guide 7; an inflow guide 11 formed at a front surface of the scroll 9 that corresponds with the indoor heat exchanger 5; and an indoor fan 13 formed within the scroll 9.

Discussion of the construction and operation for the indoor unit part will be made below.

At a lower side of the front grill 3, an intake part 31 is formed as a passage through which indoor air is introduced. At an upper side of the front grill 3, a discharge grill 32 is formed which allows air heat-exchanged in the indoor heat exchanger 5 to be again discharged toward the indoors.

The indoor heat exchanger 5 is disposed at an inner side of the front grill 3. The indoor heat exchanger 5 exchanges heat between the entering through the intake part 31 and the working fluid.

The air guide 7 partitions the air conditioner into indoor and outdoor portions. Accordingly, the air guide 7 shields an indoor cool air from an outdoor hot air by the air guide 7. Further, a brace 8 is formed at an upper stage of the air guide 7, that connects with a shroud 18 which will be described below.

A flow guide surface 91 is formed within the scroll 9. As may be seen in FIG. 1, the flow guide surface 91 has a curvature from one side to the other side, to guide smooth flow of the indoor air. Further, an orifice 11 includes an orifice hole 12 which guides indoor air passing through the indoor heat exchanger 5 into an indoor fan 13. The orifice 11 also has a discharge guide 111 formed at an upper stage of the orifice 11 to guide heat-exchanged air into a discharge grill 32.

The indoor fan 13 intakes indoor air through the intake part 31, the indoor heat exchanger 5 and the orifice hole 12. Additionally, the indoor fan 13 is a centrifugal fan which intakes air through the orifice hole 12, and then blows the air in a centrifugal direction. The outlet air from the indoor fan 13 is guided along the flow guide surface 91 to flow into the discharge guide 111.

The above description is for the indoor unit part of the integral type air conditioner. A construction and operation of the outdoor unit part partitioned from the indoor unit part by the air guide 7 will be henceforth described below.

The outdoor unit part includes a motor 15 formed outside of the air guide 7; and a blower fan 17 fixed to an outdoor rotor axis of the motor 15. The outdoor unit part also has a shroud 18 formed on the base panel 1 to guide an air stream formed by the blower fan 17; an outdoor heat exchanger 19 formed at the outdoor base panel 1 to face with the shroud 18; and an outer case 21 for forming an outershell of the air conditioner.

The motor 15 protrudes such that two sides of a rotation axis of the motor 15 face each other. One side of the rotation axis passes through the air guide 7 and extends to a center of the scroll 9, thereby rotating the indoor fan 13. Additionally, the other side of the rotation axis is formed at the blower fan 17 which results in an outdoor airflow. The blower fan 17 further includes a ring 171 which connects its wing ends with one another.

The shroud 18 includes a passage hole 181 within which the blower fan 17 is positioned. Further, the shroud 18 guides outside air the blower fan 17 intakes, and forces the flow of outdoor air towards the outdoor heat exchanger 19. The shroud 18 connects to both side ends of the outdoor heat exchanger 19, and is supported by the brace 8 at an upper stage.

The outdoor heat exchanger 19 allows the intake air from outside and the operation fluid of an air conditioning cycle to be heat-exchanged with each other.

A compressor 20 is disposed as a structural element of the air conditioning cycle on the base panel 1 between the air guide 7 and the shroud 18. On the base panel 1, a compressor mounting part 10 on which the compressor 20 is mounted is formed.

FIG. 2 is a view illustrating a usage state of a related art air conditioner.

Referring to FIG. 2, when the air conditioner begins operation, the indoor unit part introduces air through the intake part 31 disposed at a lower side surface of the front grill 3. The indoor part then cools the introduced air and outputs the cooled air back indoors through the discharge grill 32 disposed at an upper surface of the front grill 3. Further, the outdoor unit part intakes air through the passage hole of the outer circumference surface of the outer case 20. Heat-exchange then occurs with the air the outdoor unit part intakes and the heat-exchanged air exits toward the outdoors through another passage hole provided on a rear surface of the outer case 20. In the drawings, arrows represent airflow.

However, the above-described related-art integral type air conditioner has the following drawbacks.

The related art integral type air conditioner includes the indoor fan 13, the outdoor fan 17 and the motor 15. However, heat-exchange efficiency deteriorates in the related-art integral type air conditioner since the indoor heat exchanger 5 and the outdoor heat exchanger 19 are formed in an appropriately rectangular shape such that the forcible airflow generated by the circular indoor fan 13 and outdoor fan 17 does not reach an entirety of the heat exchangers 5 and 19. To further illustrate, air flow does not reach corner portions of the heat exchangers 5 and 19. Thus, full heat-exchange does not occur at those corner portions.

Further, the compressor 20 is deflected and installed at one side of the base panel 1. Accordingly, the related art integral type air conditioner has the drawback in that movement and installation is difficult since the weight of the compressor 20 moves the center of gravity of the air conditioner to one side. Thus, the shifted center of gravity increases the difficulty associated with moving the air conditioner.

SUMMARY OF THE INVENTION

Accordingly, the present invention is directed to an integral type air conditioner that substantially obviates one or more problems due to limitations and disadvantages of the related art.

It is an advantage of the present invention to provide an integral type air conditioner which allows greater air flow to a total surface of a heat exchanger.

It is another advantage of the present invention to provide an integral type air conditioner which minimizes shifting of a center of gravity of the air conditioner thereby decreasing the difficulty associated with transporting and handling of the air conditioner.

It is another advantage of the present invention to provide an integral type air conditioner which improves an appearance of an air conditioner.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these advantages and in accordance with the invention, as embodied and broadly described herein, there is provided an integral type air conditioner comprising a base panel on which a heat exchange cycle is mounted. The base panel forms a lower appearance. A compressor also mounts on the base panel. An indoor heat exchanger and an outdoor heat exchanger are installed on a front portion and a rear portion of the base panel. An air guide, which guides air flow, is also mounted on the base panel. The air guide partitions the air conditioner into an indoor unit part formed at the front portion of the base panel and an outdoor unit part formed at the rear portion of the front panel. Two or more indoor fans which generate air flow in the indoor part penetrate the air guide. At least two outdoor fans are provided at one side of the outdoor heat exchanger. The at least two outdoor fans generate air flow in the outdoor unit part. A front panel is installed at a front end of the base panel and forms a front appearance of the air conditioner. A cabinet is also fixed at left and right side portions on the base panel and forms an upper appearance and a side appearance of the air conditioner.

In another aspect of the present invention, there is provided an integral type air conditioner comprising a base panel on a heat exchange cycle is mounted. The air conditioner further includes a compressor for compressing a working fluid of the air conditioner and a lower air guide mounted on the base panel which partitions the air conditioner into an indoor unit part formed at an approximate front portion of the base panel and an outdoor unit part formed at a rear portion of the front panel. The lower air guide also guides air flow. An indoor heat exchanger and outdoor heat exchanger are also installed on a front portion and a rear portion of the lower air guide in which a working fluid exchanges heat. In addition, an indoor fan and an outdoor fan are respectively installed at the indoor unit part and the outdoor unit part. In one embodiment, either the indoor fan or the outdoor fan may include a second fan. An upper air guide is also arranged on the lower air guide and forms a passage for discharged air. In addition, the air conditioner has a fan motor for driving the indoor fan and the outdoor fan and a front panel installed at a front end of the base panel which forms a front appearance of the air conditioner. The air conditioner also has a cabinet forming an appearance of the air conditioner.

In another aspect of the present invention, there is provided an integral type air conditioner comprising a base panel on a heat exchange cycle is mounted; a compressor for compressing working fluid of the air conditioner and a lower air guide mounted on the base panel, for partitioning the air conditioner into an indoor unit part formed at an approximate front portion of the base panel and an outdoor unit part formed at a rear portion of the front panel. Furthermore, the air conditioner includes an indoor heat exchanger and outdoor heat exchanger disposed respectively at a front side and a rear side of the lower air guide and in which the working fluid exchanges heat and an indoor fan and outdoor fan disposed respectively at the indoor unit part and the outdoor unit part. In one embodiment of the present invention, either the indoor fan or the outdoor may have a second fan. An upper air guide is also mounted on the lower air guide and allows branching of discharged air into at least two paths and discharge of the air. The air conditioner also has a fan motor for driving the indoor fan and the outdoor fan; a front panel installed at a front end of the base panel and forming a front appearance of the air conditioner; a filter disposed at least one portion of a discharge side of the upper air guide which filters the discharged air. The air conditioner also includes a cabinet which forms an appearance of the air conditioner.

In a further aspect of the present invention, there is provided an integral type air conditioner comprising a base panel; an air guide for partitioning the base panel in a front and rear direction and indoor and outdoor heat exchangers respectively arranged at a front side and a rear side of the air guide. The integral type air conditioner also includes two or more indoor fans formed to blow air into the indoor heat exchanger such that the air is blow to an entire surface of the indoor heat exchanger; two or more outdoor fans formed to blow air into the outdoor heat exchanger; a fan motor for driving the indoor fans and the outdoor fans using a single driving shaft; and a cabinet forming an appearance of the air conditioner.

The integral type air conditioner according to the present invention has an advantage in that an efficiency of a heat exchange is improved and it is easy to handle the air conditioner.

Further, there is an advantage in that an appearance of the air conditioner is improved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the embodiments of the present invention, examples of which are illustrated in the accompanying drawings.

Figure 1:
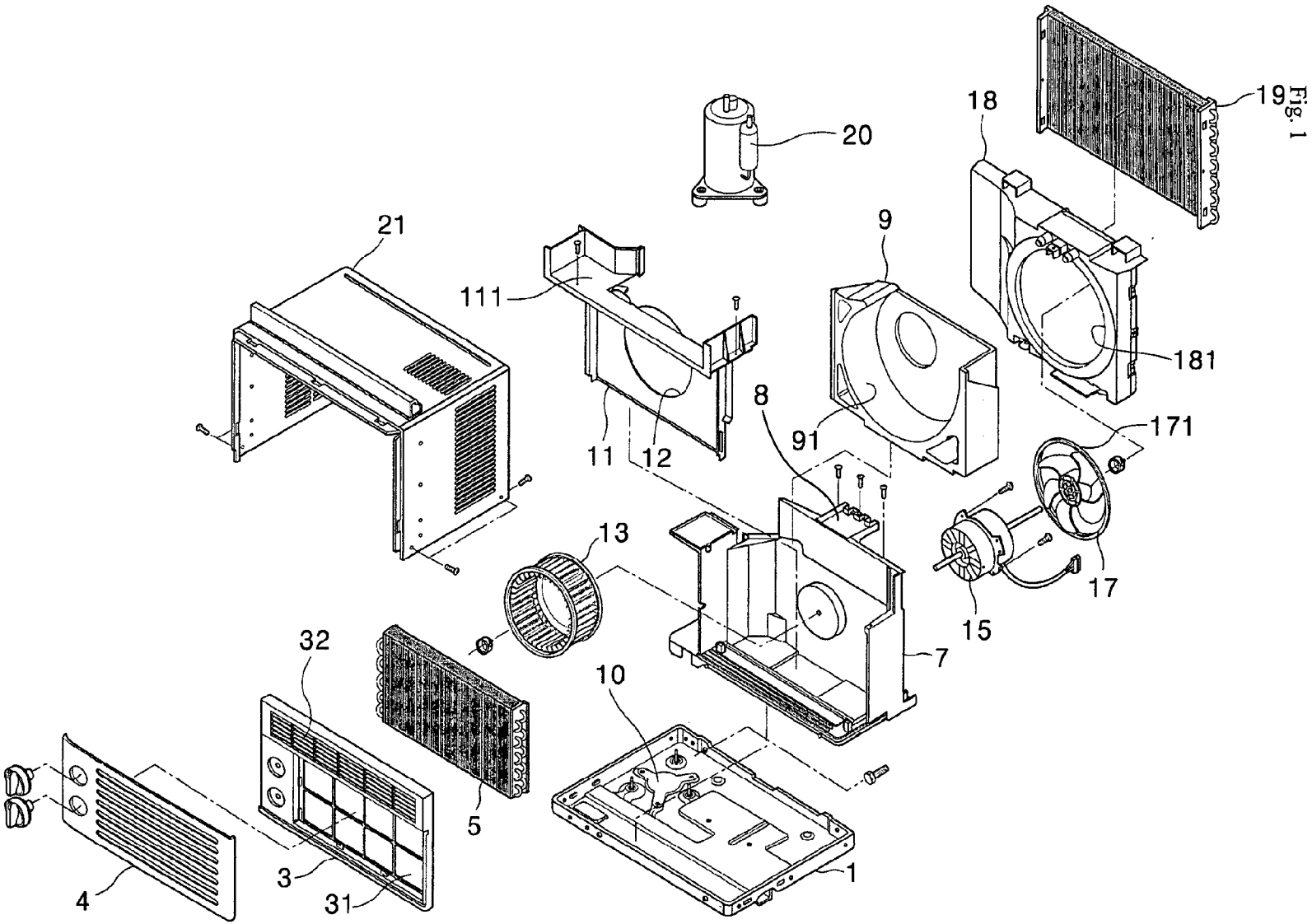
FIG. 1 is a disassembled perspective view illustrating elements of a related-art integral type air conditioner.
Figure 2:
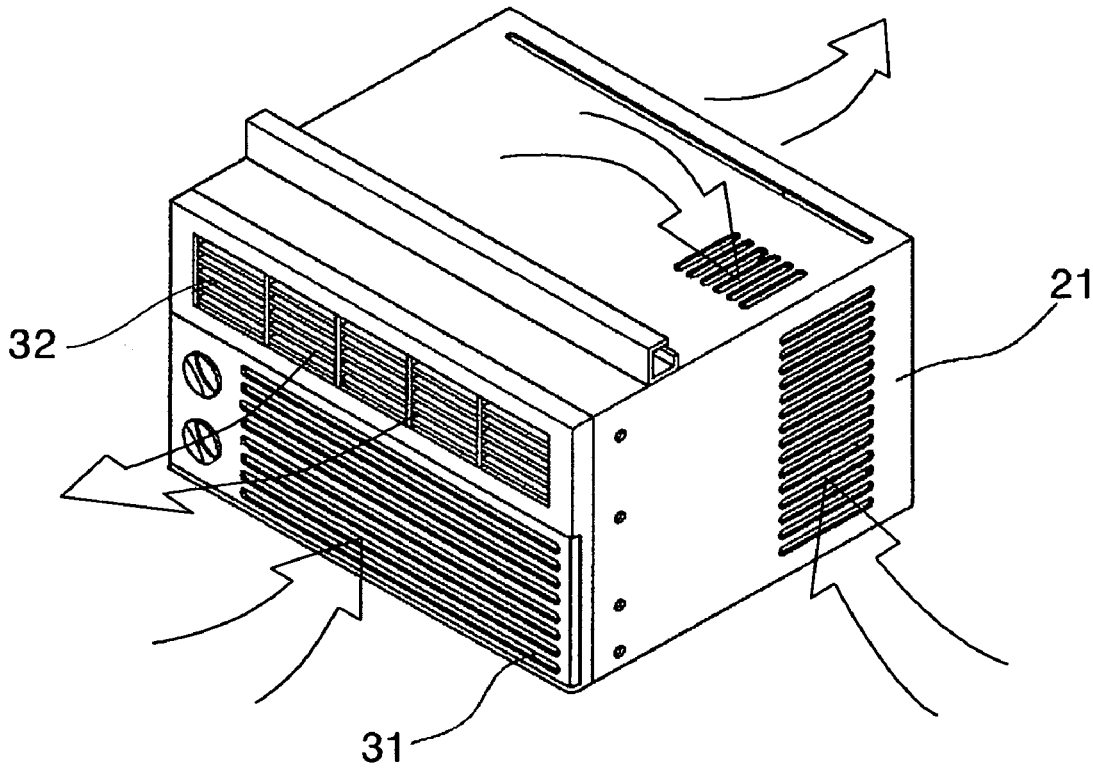
FIG. 2 is a perspective view illustrating an appearance and airflow of a related-art integral type air conditioner.
Figure 3:
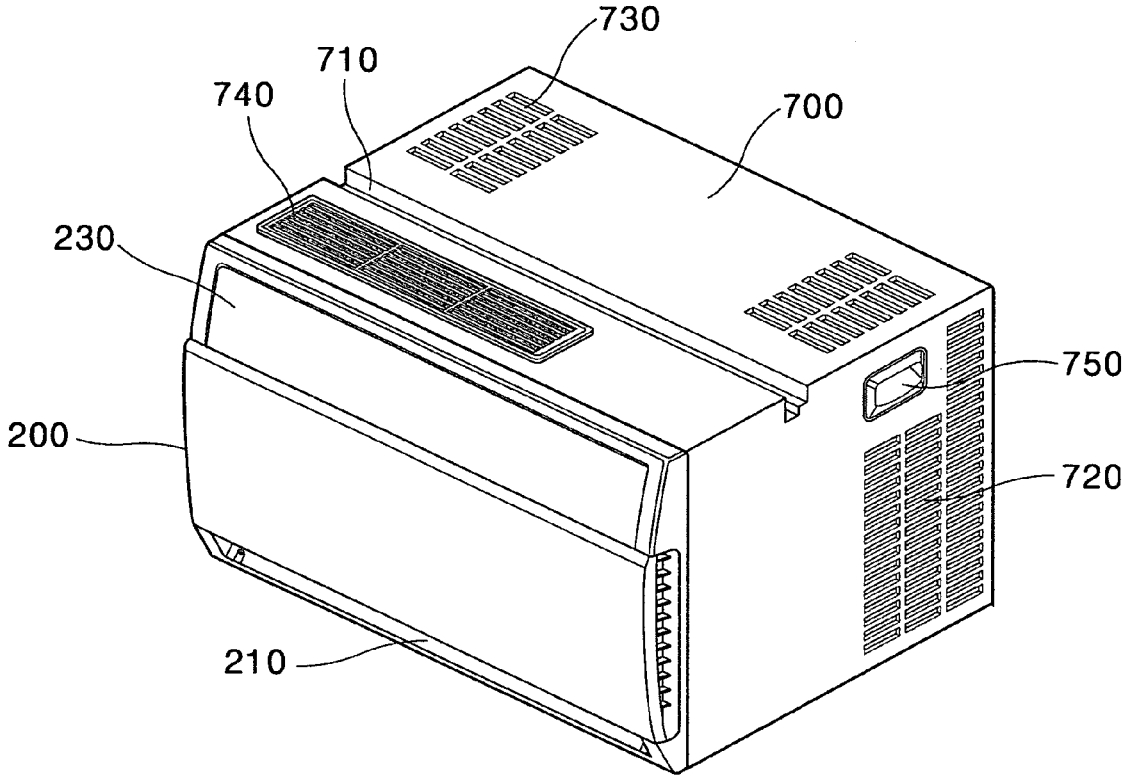
FIG. 3 is a perspective view illustrating an integral type air conditioner according to an embodiment of the present invention.
Figure 4:
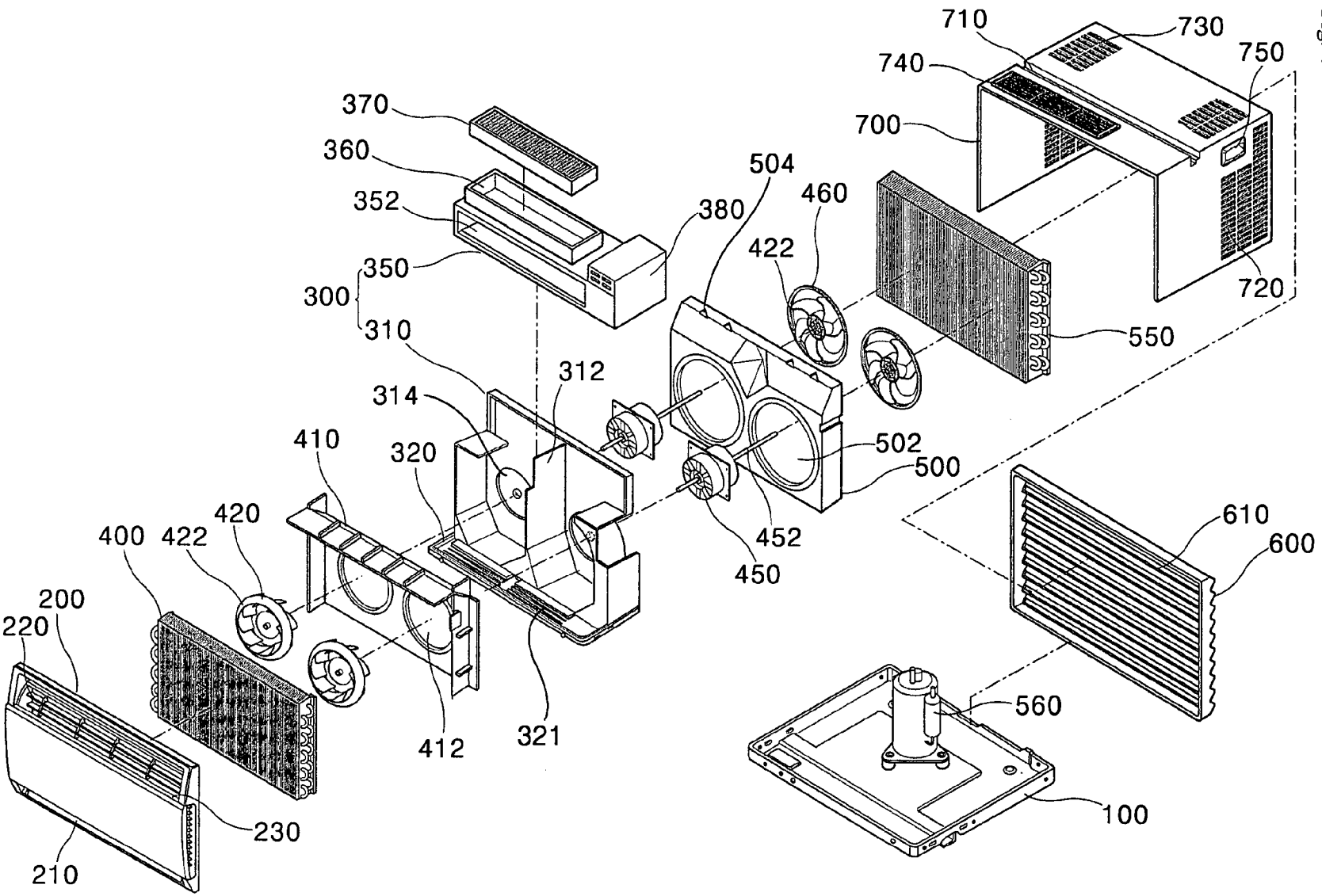
FIG. 4 is a disassembled perspective view illustrating an integral type air conditioner according to an embodiment of the present invention.

FIG. 3 is a partial cutaway perspective view of an integral type air conditioner according to an embodiment of the present invention, and FIG. 4 is an exploded perspective view of an integral type air conditioner according to the present invention.

Referring to FIGS. 3 and 4, an integral type air conditioner includes a base panel 100 that is the bottom of the air conditioner. The integral type air conditioner also has a cabinet 700 that provides an outer appearance of the air conditioner and in which various parts constituting a heat exchange cycle are housed. An indoor side of the cabinet 700 has an indoor unit part which intakes warm air and exhausts cool air, and an outdoor unit part received in an outdoor part of the cabinet 700 that cools working fluid.

Hereinafter, the construction of the indoor unit part will be described.

In the air conditioner according to the present invention, the construction of the indoor unit part includes: a front panel 200 disposed at a front most end of the air conditioner to form the outershell structure of the front side and, a discharge door 230 arranged at a rear side of the front panel 200. The discharge door 230 selectively opens and closes a discharge part of the front panel. In addition, the conditioner has an air guide 300 arranged on the base panel 100 that partitions the air conditioner into the indoor unit part and the outdoor unit part. The air guide 300 includes an upper air guide 350 and a lower air guide 310 in order to guide air flow in the indoor unit part. The air conditioner also includes an inner base plate 320 integrally formed at a lower portion of the lower air guide 310. Moreover, the air conditioner has left and right barriers 312 formed on a central portion of a front surface of the lower air guide 310 in an upper and lower direction and a discharge passage 352 formed in a front side of the upper air guide 350. The discharge passage 352 guides cooled air discharged from an indoor fan 420 to the front panel 200. In addition, the air conditioner includes a filter installation part 360 that protrudes in an upwardly direction on the upper air guide 350 and a control box 380 installed at a right side of the upper air guide 350. The control box 380 controls the operation of the air conditioner. Further, the air conditioner has an indoor heat exchanger 400 arranged in a front side of the air guide 300 which cools air and an inflow guide 410 formed between the indoor heat exchanger 400 and the air guide 300. The inflow guide forms an inflow path of air. The air conditioner also includes an indoor fan 420 arranged inside the lower air guide 310 which causes an indoor air flow; and a fan motor 450 arranged at a rear side of the indoor fan 420. The fan motor allows rotation of the indoor fan 420. Next, the construction of the outdoor unit part will be described.

The outdoor unit part includes: a shroud 500 arranged in a rear side of the outdoor unit. In this embodiment, the shroud 500 is located a predetermined distance from the air guide 300. The shroud 500 guides air flow in the outdoor unit part. The outdoor unit part also includes an outdoor fan disposed in a through hole 502 of the shroud 500. The outdoor fan forcibly blows an outdoor air in order to facilitate heat exchange. In addition, the outdoor unit part has an outdoor heat exchanger 550 in a rear side of the shroud 500 and a compressor 560 mounted on the base panel 100 of the outdoor unit part which constitutes a heat exchange cycle. Moreover, the outdoor unit part has a rear panel 600 arranged in a rear side of the outdoor heat exchanger 550 and through which heat-exchanged hot air discharges. In the integral type air conditioner according to the present invention, the construction of the indoor unit part will now be described in more detail.

The front panel 200 includes: a front inhaling part 210 formed at a lower side of the front panel 200 that corresponds to an inlet for inhaling air from a space to be air conditioned into the indoor side of the air conditioner. The front panel 200 also has a discharge part 220 formed at an upper side of the front panel 200 through which heat-exchanged air discharges into a space to be air conditioned. The heat-exchanged air selectively discharges through either the aforementioned discharge part 220 or the filter installation part 360. Alternatively, a filter may be installed inside the filter installation part 360 that filters foreign particles in the discharged air.

In an alternative embodiment of the present invention, the discharge part 220 may be formed at both sides of the front panel 200. To further illustrate, in order to cool the indoor side by discharging cool air in a side direction in relation to a front side of the air conditioner, and to enhance an appearance of the air conditioner, a side inhaling part 215 may be formed at both side ends of the front panel 200.

A rear side of the front panel 200 has a discharge door 230 that selectively opens and closes the discharge part 220. The discharge door 230 selectively opens or closes the discharge part 220 by sliding in an upward or downward as desired. The discharge door 230 may further include a rotary motor for generating a rotary power, and a rack and pinion for changing the rotary power generated from the rotary motor into the linear motion (not shown) thereby sliding the discharge door 230 up and down.

At the front end of the discharge part 220, a discharge guide member 222 that guides the discharge direction of the discharged air is further provided.

The inner base plate 320 protrudes from a lower side of the lower air guide 310 in a front direction. The inner base plate 320 corresponds to the front end of the base panel 100 and fixes to the base panel 100. An upper portion of the inner base plate 320 collects and exhausts water condensed by the indoor heat exchanger 400 to an outdoor space. At the upper portion, the inner base plate 320 also includes a guide rib 321 at an upper portion thereof that collects the condensed water.

At a front center portion of the lower air guide 310, a left and right barrier 312 is formed in a longitudinal direction. In this embodiment, the left and right barrier 312 protrudes in a front direction from the front center portion of the lower air guide 310 thereby partitioning the front space of the lower air guide 310 into a left space and a right space. The left and right barrier 312 balances in the center of gravity due to the indoor fans 420 and the motors 450 respectively arranged at the left side and the right side. In addition, airflow from the respective indoor fans 420 may be formed independently.

At both portions of the lower air guide 310, indoor fan installation grooves 314 are formed. The indoor fan installation grooves 314 correspond to the diameter of the indoor fan 420. In addition, a circumference of the indoor fan installation grooves protrudes toward the front side a predetermined amount.

The discharge passage 352 protrudes a predetermined portion from the rear end of the upper air guide 350 toward the front side. A front end of the discharge passage 352 corresponds to the discharge part 220 of the front panel 200.

On the upper air guide 350, a filter installation part 360 protrudes in an upward direction. A high performance filter 370 that filters air discharged into the indoor space mounts on the filter installation part 360 from an upper side.

The control box 380 has a predetermined size and accommodates capacitors and control elements such as a circuit board (not shown) that control the operation of the air conditioner. The control box 380 may control the operation of the air conditioner.

Heat exchange occurs between the working fluid of a heat exchange cycle and the intake air in an air conditioning space in the indoor heat exchanger 400. Although not shown in the drawings, a tubular path through which working fluid is introduced or discharged may be formed.

The inflow guide 410 guides air heat-exchanged in the indoor heat exchanger 400. At the inflow guide 410, a pair of through holes 412 correspond to the indoor fan installation grooves 314 of the lower air guide 310. Inside the air guide 300, the indoor fans 420 provide a driving force for air flow in the indoor unit side. The indoor fans 420 have one pair at the left side and one pair at the right side. For example, the indoor fans 420 are respectively located at the indoor fan installation grooves 314 formed at the left and right sides of the lower air guide 310.

A front end of a central shaft 452 of each fan motor 450 inserts into the indoor fan 420 and the other end inserts into the outdoor fan 460. Accordingly, the fan motor 450 simultaneously supplies a rotational driving force to both the indoor fan 420 and the outdoor fan 460. To further illustrate, the rotational shaft of the fan motor 450 extends in both directions, and the indoor fan 420 couples with one end and the outdoor fan 460 couples with the other end. Also, the fan motor 450 mounts on the rear surface of the air guide 300. In an alternative embodiment of the present invention the air guide 300 may be supported by a separate bracket.

A vent hole (not shown) may be further formed at a predetermined portion of the air guide 300 and the inflow guide 410. In this embodiment, outer air selectively enters through the vent hole thereby venting inner air. Accordingly, a damper is installed at a predetermined portion of the air guide 300, and is operated by a separate driving motor to open and close the vent hole.

Meanwhile, although not shown in the drawings, a vent tunnel which guides outdoor air, may be further formed such that outer air is introduced through the vent hole. To further illustrate, a vent tunnel which guides tear air to a front side and allows introduction of the guided air into the vent hole may be further formed below a brace (not shown) connecting between the upper end of the air guide 300 and the shroud 500.

In the integral type air conditioner according to the present invention, the construction of the outdoor unit part will be described in detail. At the left and right portions of the shroud 500, vent holes 502 are respectively formed which correspond to the indoor fan installation grooves 314 of the air guide 300. Also, at an upper portion of the shroud 500, a guide bead 504 which guides condensed water guided by a ring 422 formed on an outer circumference of the outdoor fan 460 may be formed.

The ring 422 splashes condensed water on a lower portion in order to spray the splashed water on the outdoor heat exchanger 550. The ring 422 lowers temperature of the outdoor heat exchanger 550 during cooling operations thereby enhancing cooling efficiency.

The outdoor heat exchanger 550 discharges indoor heat to an exterior while the air conditioner is in the cooling mode. It should be noted that when the air conditioner is in the cooling mode, heat exchange occurs between the working fluid of a heat exchange cycle and outside air.

The compressor 560 connects with the indoor heat exchanger 400 and the outdoor heat exchanger 550 by a tubular path in order to circulate refrigerant. In particular, the compressor is installed between the air guide 300 and the shroud 500. In addition, in this embodiment, the compressor 560 is also disposed between the left fan motor 450 and the right fan motor 450. As such, the compressor 560 is located at the center of the outdoor unit part with respect to the left and right directions.

At the rear panel 600, a plurality of grill discharge outlets 610 through which inner air discharges are formed in the horizontal direction. The grill discharge outlets 610 are made by forming a plurality of triangular protrusions on the rear panel and cutting away a furrow portion between the protrusions in the horizontal direction.

Figure 5:
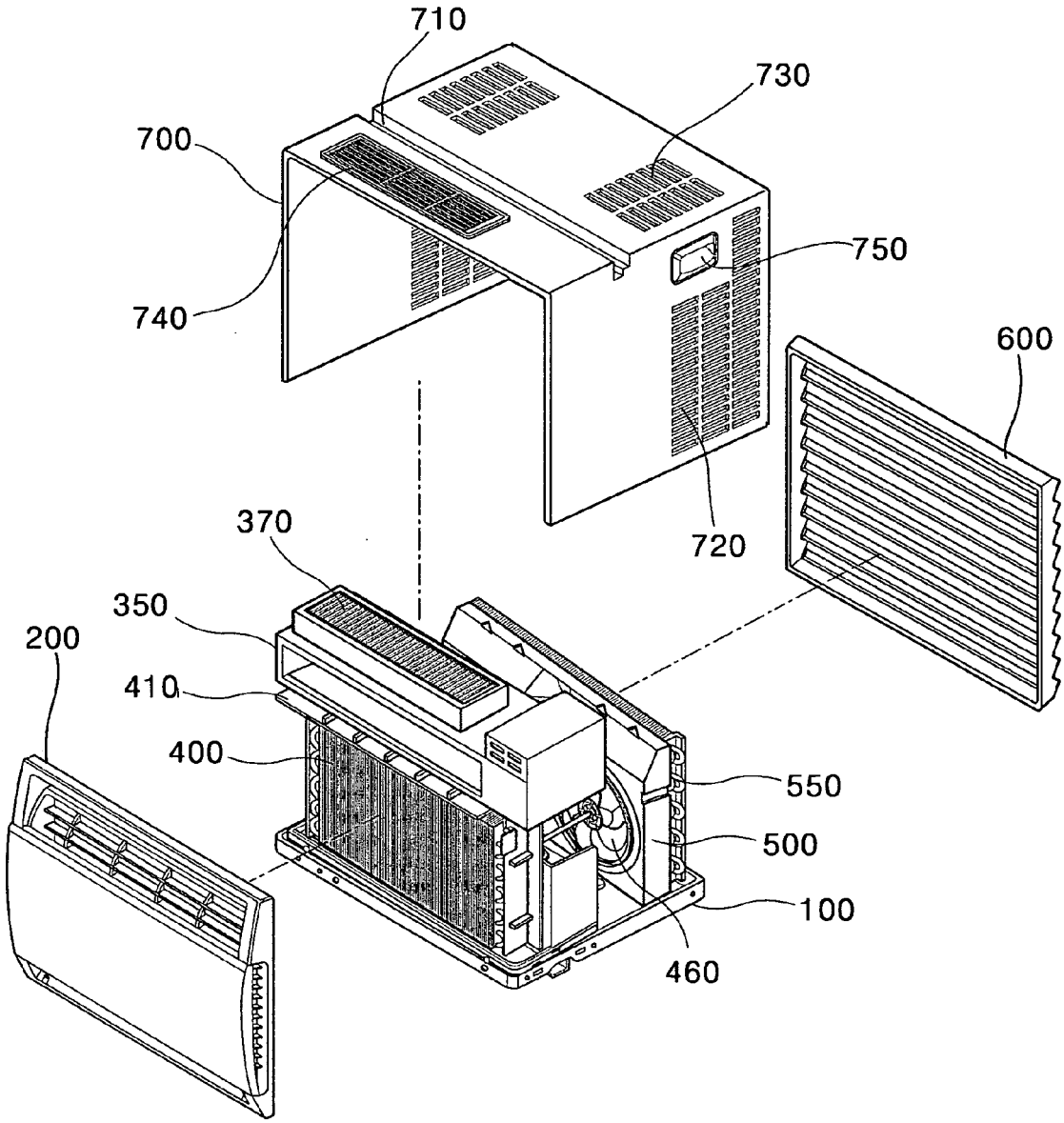
FIG. 5 is a view depicting an appearance structure of an integral type air conditioner according to an embodiment of the present invention.

FIG. 5 is a view illustrating an integral type air conditioner according to the present invention. Referring to FIG. 5, the cabinet of the integral type air conditioner according to the present invention will be described in detail.

The cabinet 700 covers the air conditioner except for a lower side portion and a front and rear portions in order to shield the elements of the air conditioner. The cabinet 700 also forms air passages inside the air conditioner.

In detail, an installation guide part 710 is formed in a predetermined position on an upper surface of the cabinet 700 in a horizontal direction. The installation guide part 710 recesses in a downward direction a predetermined depth from the upper surface of the cabinet 700. The installation part 710 mounts the air conditioner along a window frame of a building. A curtain assembly or the like can be mounted on the installation guide part 710.

At rear portions of both side portions of the cabinet 700, a plurality of side intake holes 720 are formed through which air enters from side directions. At a rear portion of the upper portion of the cabinet 700, a plurality of upper intake holes 730 are selectively formed through which air enters from an upper direction.

Also, at the front edge of the upper portion of the cabinet 700, i.e., at the front side of the installation guide part 710, a filter grill 740 which guides the discharge direction of the air that passes the high performance filter 370 is installed. The filter grill 740 corresponds to the upper surface of the high performance filter 370 mounted on the upper air guide 350. As such, the air that has passed the high performance filter 370 smoothly discharges to the outside. Also, since the high performance filter 370 is formed in a separate assembly, the high performance filter 370 may be equipped attachably and detachably. The grill mounting part 742 on which the filter grill 740 mounts both protrudes from and penetrates the upper surface of the cabinet 700 at a predetermined portion. The filter grill 740 mounts on the grill mounting part 742 from an upper direction. Accordingly, during cleaning of the filter grill 740, the filter grill 740 is lifted up, separated from the cabinet 700 and then cleaned. A handgrip 750 is formed at both side portions of the cabinet 700 for easy installation and movement.

Hereinafter, operation of an integral type air conditioner as constructed above will be described. It is noted that the operation of the integral type air conditioner is described on the basis of an operation standard of a cooling mode.

Figure 6:
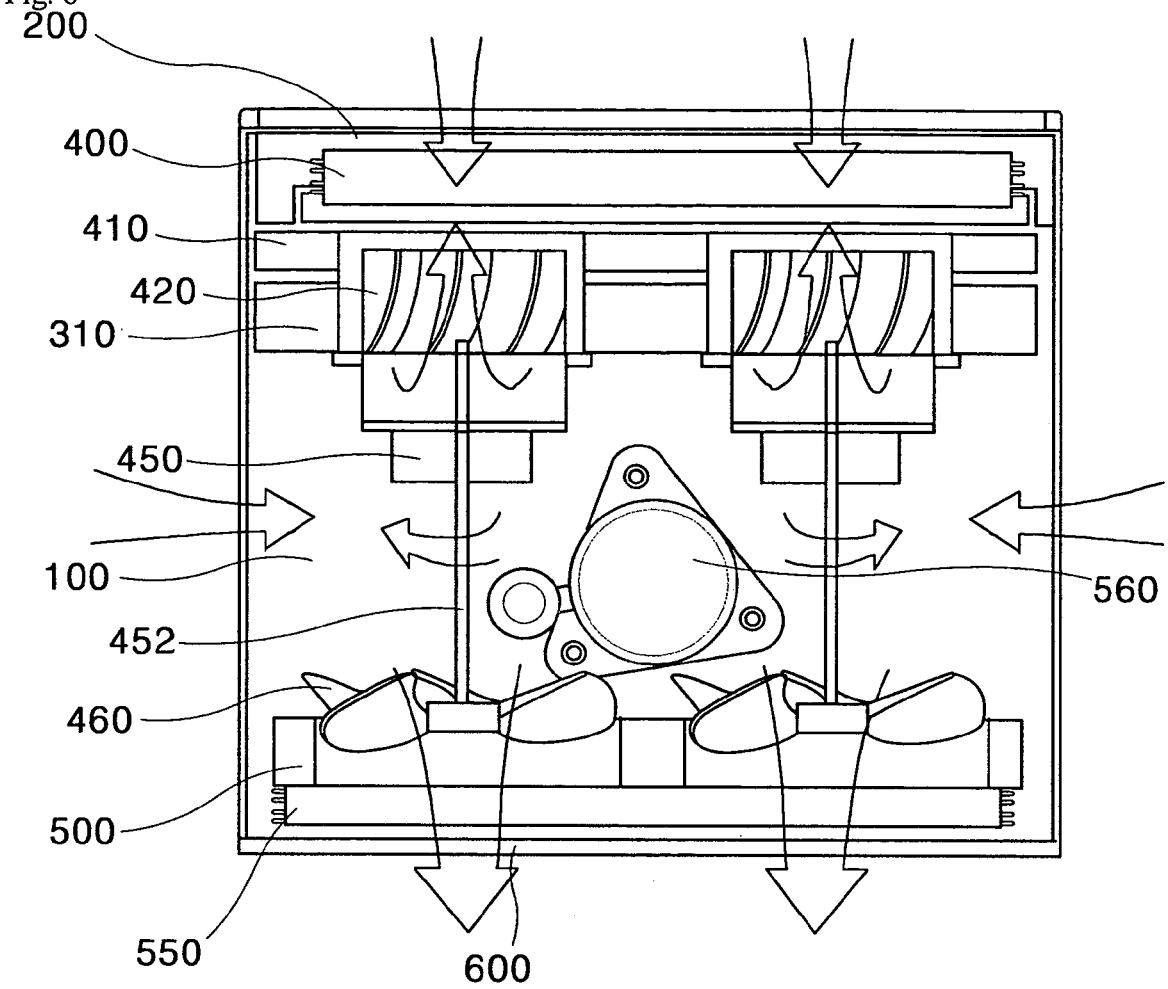
FIG. 6 is a plane sectional view illustrating an integral type air conditioner according to an embodiment of the present invention.

FIG. 6 schematically illustrates a plane sectional view of the integral type air conditioner according to the present invention. It is noted that only main parts are illustrated, in order to describe the operation of the air conditioner.

During operation of the air conditioner, the left and right fan motors 450 rotate the left indoor fan 420 and the right indoor fan 420. Additionally, the compressor 560 allows circulation of the working fluid through the heat exchange cycle and compresses the working fluid. Specifically, the indoor fan 420 uses a centrifugal fan thereby effectively using indoor space, and the outdoor fan 460 uses an axial fan in order to increase air flow.

The driving of the indoor fan 420 at the left and right sides causes inhalation of indoor air through the front inhaling part 210 and to a relatively low temperature through the indoor heat exchanger 400. The air heat-exchanged to a relatively low temperature in the indoor heat exchanger 400 enters into the indoor fan 420. The air then discharges in the circumference direction of the indoor fan. For this, the centrifugal fan of the indoor fan 420 can be applied, and especially the indoor fan 420 may be a turbo fan so as to increase air flow.

The air discharged in the circumference direction of the indoor fan 420 is guided along the air guide 300 into the discharge passage 352. The air guided into the discharge passage 352 is discharged indoors through the discharge part 220.

In order to purify the air cooled by the indoor heat exchanger 400 as described above, air passes through the high performance filter 370.

In detail, if a user sets the air purifying function in the air conditioner having the above construction, the discharge door 230 shields the discharge part 220 of the front panel 200. Accordingly, the air guided and discharged into the discharge passage 352 not discharged into the discharge part 220. Instead, the air discharges through the filter grill 740 via the upper high performance filter 370.

During operation, since the discharged air passes through the high performance filter 370, the present invention cleans an indoor environment. Since the present invention cleans and cools indoor air, the present invention provides a delightful indoor environment.

Driving of the outdoor fan 460 causes the inflow of outdoor air into the air conditioner. More specifically, the rotation of the outdoor fan 460 causes inflow of external air into the air conditioner through the side intake hole 720 and the upper intake hole 730 of the cabinet 700. The air introduced into the air conditioner which is to enter into the outdoor fan 460 is guided along the shroud 500. Additionally, the air discharged to the rear by the outdoor fan 460 passes through the outdoor heat exchanger 550 while heat-exchange occurs with the working fluid of the heat exchange cycle. In addition, a hot air of the working fluid is transmitted to the air discharged outdoor.

The air introduced into the air conditioner at a relative low room temperature passes a circumference of the compressor 560 such that a temperature of the compressor 560 can be also reduced.

However, during operation of the ventilation system for ventilating air of the air condition space externally, if a user opens a ventilation hole provided at one side of the air guide 300, the discharge part 220 is shielded by the discharge door 230.

Accordingly, entering through the front inhaling part 210 passes through the indoor heat exchanger 400. The air then flows toward the outdoor side through the ventilation hole, and then will be discharged into the side intake hole 720 or discharged through the grill discharge hole 610 of the rear surface panel 600.

The above-described construction may also be suitably modified. To further illustrate, in an embodiment of the present invention, a pair of indoor fans 420 are provided at the indoor side. A pair of outdoor fans 460 corresponding to the pair of indoor fans 420 are also provided at the outdoor side. Additionally, a pair of fan motors 450 are provided for both the indoor fan 420 and the outdoor fan 460.

In another embodiment, two indoor fans may be provided at the indoor side in order to increase heat-exchange efficiency. In addition, in this embodiment, one outdoor fan 460 and a separate outdoor fan motor which drives the outdoor fan 460 are provided at the outdoor side.

The above embodiment may be modified such that the indoor fan is singularly constructed, and two outdoor fans are constructed such that the compressor is installed therebetween.

Further, an air conditioner in accordance with this embodiment can achieve the same effect in case the air conditioner is used for cooling and as a heat pump.

Furthermore, in order to increase heat exchange efficiency, the present embodiment includes two indoor fans and two outdoor fans. However, it should be noted that any number of fans may be used depending on a total size and a desired cooling efficiency of the air conditioner.

The fan motor 450 couples at a rear surface of the lower air guide with a separate bracket (not shown). However, the fan motor 450 may couple with air conditioner using any suitable method. To further illustrate, the fan motor 450 may be coupled directly to the air guide. In detail, only the driving shaft of the fan motor is not inserted into the lower air guide. Instead, the entire body of the fan motor 450 can be inserted into the lower air guide and mounted.

Also, a picture frame may be installed at a front surface of the front panel 200 thereby enhancing an appearance of the integral type air conditioner. Further, a flat display panel, for instance, a LCD monitor or a PDP panel can be formed at a vacant space of the front surface of the front panel 200 for use as an electronic picture, a monitor or a television.

Furthermore, the compressor is installed at the center portion of the integral type air conditioner increases the portability of the air conditioner of the present invention. Although the outdoor fan 460 includes two separate units, i.e., one pair, the compressor is not necessarily placed there between. More specifically, although the compressor is placed at any one side of the outdoor construction in the embodiments shown above, heat exchange efficiency in accordance with the present invention may be enhanced if blowing occurs throughout the entire area of the heat exchanger.

The present invention improves heat exchange efficiency since ventilation may be performed toward the total area of the indoor heat exchanger and the outdoor heat exchanger having a rectangular shape.

Further, the fan and the motor are respectively formed at the left and right sides of an air conditioner such that a spare space of the outdoor side central part can be formed. In accordance with an embodiment of the present invention, the compressor may be mounted in this space such that a total center of gravity of the air conditioner can be adjusted. Therefore, an air conditioner of the present invention may be conveniently transported. In detail, since an air conditioner of the present invention maintains left and right balance, installation and movement of the air conditioner is convenient.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An integral type air conditioner comprising:

a base panel on which parts for a heat exchange cycle are mounted, the base panel forming a lower appearance;

a compressor mounted on the base panel;

an indoor heat exchanger and an outdoor heat exchanger installed on a front portion and a rear portion of the base panel, for performing heat exchange;

an air guide mounted on the base panel, for partitioning the air conditioner into an indoor unit part formed at the front portion of the base panel and an outdoor unit part formed at the rear portion of the front panel, and for guiding air flow;

at least two indoor fans penetrating the air guide for generating air flow in the indoor unit part;

at least two outdoor fans provided in one side of the outdoor heat exchanger, for generating the air flow in the outdoor unit part;

a front panel disposed at a front end of the base panel and forming a front appearance of the air conditioner; and a cabinet fixed to left and right side portions on the base panel and forming an upper appearance and a side appearance of the air conditioner.

2. The integral type air conditioner according to claim 1, wherein the compressor is installed at a rear center portion of the base panel.

3. The integral type air conditioner according to claim 1, further comprising a fan motor arranged at a rear portion of the indoor fan, for simultaneously providing the indoor fan and the outdoor fan with a rotational force.

4. The integral type air conditioner according to claim 1, wherein one of the indoor fans and/or one of the outdoor fans are/is arranged at a left side of the air conditioner and the other of indoor fans and/or the other of the outdoor fans are/is arranged at a right side of the air conditioner.

5. The integral type air conditioner according to claim 1, wherein the indoor fan is a turbo fan.

6. The integral type air conditioner according to claim 1, wherein the outdoor fan is an axial fan.

7. The integral type air conditioner according to claim 1, wherein the compressor is formed at a center portion of the outdoor unit part.

8. An integral type air conditioner comprising:

a base panel on which parts for a heat exchange cycle are mounted;

a compressor for compressing working fluid of the air conditioner;

a lower air guide mounted on the base panel, for partitioning the air conditioner into an indoor unit part formed at a front portion of the base panel and an outdoor unit part formed at a rear portion of the front panel, and for guiding air flow;

an indoor heat exchanger and an outdoor heat exchanger installed on a front portion and a rear portion of the lower air guide, and in which the working fluid exchanges heat;

indoor and outdoor fans installed at the indoor unit part and the outdoor unit part respectively, one of the indoor fan and the outdoor fan being two or more fans comprising;

an upper air guide arranged on the lower air guide, fonning a passage of discharged air;

a fan motor for driving the indoor fan and the outdoor fan;

a front panel installed at a front end of the base panel and forming a front appearance of the air conditioner; and a cabinet forming an appearance of the air conditioner.

9. The integral type air conditioner according to claim 8, wherein air heat-exchanged in the heat exchange cycle is discharged through an upper side surface of the upper air guide.

10. The integral type air conditioner according to claim 8, further comprising:

a filter installation part formed at an open upper surface of the upper air guide; and a filter formed inside the filter installation part, for filtering the discharged air.

11. The integral type air conditioner according to claim 8, further comprising a discharge passage formed at a front portion of the upper air guide, for discharging cooled air through the front surface of the air conditioner.

12. The integral type air conditioner according to claim 8, further comprising a second outdoor fan and the compressor is arranged between the outdoor fans.

13. The ihtegral type air conditioner according to claim 8, wherein the air is branched and blown into the left and right sides of the indoor heat exchanger and/or the outdoor heat exchanger by the indoor fan and/or the outdoor fan.

14. An integral type air conditioner comprising:

a base panel on which parts constituting a heat exchange cycle are mounted;

a compressor for compressing working fluid of the air conditioner;

a lower air guide mounted on the base panel, for partitioning the air conditioner into an indoor unit part formed at an approximate front portion of the base panel and an outdoor unit part formed at a rear portion of the front panel;

an indoor heat exchanger and an outdoor heat exchanger disposed at a front side and a rear side of the lower air guide respectively and in which the working fluid exchanges heat;

an indoor fan and an outdoor fan disposed respectively at the indoor unit part and the outdoor unit part, one of the indoor fan and the outdoor fan comprising at least two fans;

an upper air guide mounted on the lower air guide and allowing the discharged air to be branched into at least two paths and discharged;

a fan motor for driving the indoor fan and the outdoor fan;

a front panel installed at a front end of the base panel and forming a front appearance of the air conditioner;

a filter disposed at least one portion of a discharge side of the upper air guide, for filtering the discharged air; and a cabinet forming an appearance of the air conditioner.

15. The integral type air conditioner according to claim 14, wherein the filter is disposed at an upper portion of the upper air guide.

16. The integral type air conditioner according to claim 14, further comprising a filter grill formed at a position corresponding to the filter and through which the heat-exchanged air is discharged.

17. An integral type air conditioner comprising:

a base panel;

an air guide for partitioning the air conditioner into an indoor unit part and outdoor unit part, and for guiding the air flow of the indoor unit part;

an indoor heat exchanger and an outdoor heat exchanger respectively arranged at a front side and a rear side of the air guide;

two or more indoor fans formed to blow air into an entire surface of the indoor heat exchanger;

two or more outdoor fans formed to blow air into the outdoor heat exchanger;

a fan motor for driving the indoor fans and the outdoor fans using a single driving shaft; and a cabinet forming an appearance of the air conditioner.

* * * * *